US007883041B2

(12) United States Patent
Ishikawa

(10) Patent No.: US 7,883,041 B2
(45) Date of Patent: Feb. 8, 2011

(54) MEDIA MIXING MILL

(75) Inventor: Tsuyoshi Ishikawa, Narashino (JP)

(73) Assignee: Ashizawa Finetech Ltd., Chiba-ken (JP)

( * ) Notice: Subject to any disclaimer, the term of this patent is extended or adjusted under 35 U.S.C. 154(b) by 32 days.

(21) Appl. No.: 12/384,025

(22) Filed: Mar. 31, 2009

(65) Prior Publication Data

US 2009/0242673 A1 Oct. 1, 2009

(30) Foreign Application Priority Data

Mar. 31, 2008 (JP) ..... 2008-089308

(51) Int. Cl.
*B02C 17/18* (2006.01)

(52) U.S. Cl. ..... 241/66; 241/171; 241/179; 241/180

(58) Field of Classification Search ..... 241/66, 241/68, 170–172, 179, 180
See application file for complete search history.

(56) References Cited

U.S. PATENT DOCUMENTS 5,630,557 A * 5/1997 Barthelmess ..... 241/80
5,882,246 A * 3/1999 Inkyo et al. ..... 451/87
6,630,277 B2 * 10/2003 Naka et al. ..... 430/137.18
7,014,134 B2 * 3/2006 Heinzelmann et al. ..... 241/171
7,374,116 B2 * 5/2008 Ishikawa et al. ..... 241/171
7,588,205 B2 * 9/2009 Ishikawa et al. ..... 241/171
2004/0021021 A1 * 2/2004 Ishikawa ..... 241/172
2005/0224612 A1 * 10/2005 Heinzelmann et al. ..... 241/172
2006/0261201 A1 * 11/2006 Ishikawa et al. ..... 241/171
2008/0197218 A1 * 8/2008 Ishigaki et al. ..... 241/5

FOREIGN PATENT DOCUMENTS

JP 2003-144950 5/2003
JP 2005-199125 7/2005

* cited by examiner

*Primary Examiner*—Faye Francis
(74) *Attorney, Agent, or Firm*—Renner, Kenner, Greive, Bobak, Taylor & Weber

(57) ABSTRACT

Disclosed is a media mixing mill, which is capable of obtaining a high-quality product while ensuring adequate pulverization/dispersion functions. The media mixing mill of the present invention includes a grinding container having a material inlet and a spherical-shaped grinding chamber, an agitating member rotatably installed inside the grinding chamber and in adjacent relation to an inner wall of the grinding container, grinding media contained in the grinding chamber, and a centrifugal-type media-separating member rotatably disposed inside the grinding chamber and in opposed relation to the agitating member.

7 Claims, 2 Drawing Sheets

MEDIA MIXING MILL

BACKGROUND OF THE INVENTION

1. Field of the Invention

The present invention relates to a media mixing mill. The media mixing mill is particularly suitably used, but not limited to, to mix a target material, such as ink, paint, pigment, ceramics, metal, inorganics, dielectrics, ferrite, toner, glass or paper coating color, with grinding media, to pulverize the material into fine particles or disperse the material.

2. Description of the Background Art

The media mixing mill of the present invention is one type of media agitating mill. The media agitating mill is widely used in the field of fine grinding, such as dispersion of ink or paint, pulverization/dispersion of ceramics, pulverization/dispersion of metal or inorganics, and pulverization/dispersion of medicinal drug, and various types of media agitating mills are already known.

Heretofore, the media agitating mill has been configured such that a target material and grinding media are agitated together using an agitating member provided inside a grinding container, to pulverize the target material, and the pulverized material and the grinding media are separated from each other through a separator provided at an end of a flow of the pulverized material, in such a manner as to allow only the pulverized material to be discharged from inside a grinding container.

This type of media agitating mill is essentially required to have the separator for separating a pulverized material from grinding media. As the separator, a type having a mechanical separation mechanism, such as a gap type or a screen type, has been employed.

However, in reality, the separator having a mechanical separation mechanism inevitably involves a trouble, such as blockage or clogging, which jeopardizes a stable continuous operation.

With a view to solving the problem with the above separator, there has been proposed a media agitating mill (grinder or pulverizer) comprising an agitating/separating member adapted to apply a centrifugal force to grinding media and a target material so as to agitate them and pulverize the target material, and simultaneously separate the pulverized material from the grinding media by means of a balance between the centrifugal force and a drag force of a fluid being transporting the pulverized material in a direction opposite to a direction of the application of the centrifugal force (see, for example, the following Patent Document 1).

[Patent Document 1] JP 2003-144950A

However, in the above media agitating mill (pulverizer), the agitating/separating member is costly due to its complicate structure which comprises front and rear circular disks disposed in opposed relation to each other with a given distance therebetween in an axial direction of a rotary shaft, and a plurality of blade plates integrally provided across the circular disks and arranged at even intervals in a circumferential direction of the circular disks. The agitating/separating member is significantly worn away depending on a type of target material. In this case, a cost for replacement of the agitating/separating member will be excessively increased. Moreover, the above media agitating mill (pulverizer) is adapted to adjustably change a shape of an inner peripheral surface of a grinding tank in order to cope with diversification of target materials, and thereby it is necessary to prepare a large number of the costly agitating/separating members corresponding to various shapes of the inner peripheral surface of the grinding tank, which accelerates an increase in cost.

As measures against the above problem, in JP 2005-199125A, there has been proposed a media agitating mill which comprises a low-cost agitating/separating member having a simple structure and allowing for stable pulverization and dispersion without a trouble, such as blockage or clogging.

Specifically, the media agitating mill proposed in the JP 2005-199125A comprises a grinding tank having grinding chamber defined thereinside to receive therein grinding media, a rotary shaft rotatably installed in the grinding tank, and an agitating/separating member provided to the rotary shaft in a position located inside the grinding chamber and adapted to be integrally rotatable together with the rotary shaft, wherein an outer peripheral surface of the agitating/separating member is formed in a shape conformable to that of an inner wall surface of the grinding chamber. The media agitating mill further has a separation/discharge passage penetratingly extending from the outer peripheral surface to a central portion of the agitating/separating member and then penetratingly extending from the central portion through a central portion of the rotary shaft so as to communicate with an outside of the grinding chamber, and a pressure reduction hole penetrating between upper and lower surfaces of the agitating/separating member in an axial direction of the rotary member so as to communicate between upper and lower regions of an internal space of the grinding chamber.

[Patent Document 2] JP 2005-199125A

However, in the above media agitating mill, the grinding media are apt to be locally concentrated in a maximum-diameter region where a centrifugal force is maximized, and thereby a dispersion or pulverization force will vary depending on position with a large difference therein. Thus, there is a problem of being unable to uniformly perform dispersion or pulverization of a target material to cause difficulty in obtaining a high-quality product.

SUMMARY OF THE INVENTION

It is therefore an object of the present invention to provide a media mixing mill capable of obtaining a high-quality product while ensuring adequate pulverization/dispersion functions.

The above object is achieved by a media mixing mill of the present invention having features set forth in the following (1) to (9).

(1) A media mixing mill comprising: a grinding container having a material inlet and a spherical-shaped grinding chamber; an agitating member rotatably installed inside the grinding chamber and in adjacent relation to an inner wall of the grinding container; grinding media contained in the grinding chamber; and a centrifugal-type media-separating member rotatably disposed inside the grinding chamber and in opposed relation to the agitating member.

(2) The media mixing mill set forth in (1), wherein the media-separating member is disposed adjacent to a central region of the spherical-shaped grinding chamber.

(3) The media mixing mill set forth in (1) or (2), wherein the grinding container itself has a spherical shape.

(4) The media mixing mill set forth in any one of (1) to (3), wherein the agitating member is adapted to be rotatable about a rotation axis thereof passing through a center of the spherical-shaped grinding chamber.

(5) The media mixing mill set forth in (4), wherein the grinding container is adapted to be divided into two parts, along a plane which passes through the center of the grinding chamber and orthogonally crosses through the rotation axis of the agitating member.

(6) The media mixing mill set forth in any one of (1) to (5), which further comprises a jacket provided around an outer periphery of the grinding container to allow a cooling medium or a heating medium to flow therethrough so as to adjust an internal temperature of the grinding chamber.

(7) The media mixing mill set forth in any one of (1) to (6), wherein the agitating member is adapted to be driven at a rotational velocity ranging from 5 to 40 m/s.

(8) The media mixing mill set forth in any one of (1) to (7), which is a vertical type, wherein the agitating member is disposed in a lower region of the grinding chamber, and the media-separating member is disposed in an upper region of the grinding chamber.

(9) The media mixing mill set forth in any one of (1) to (8), which further comprises a hollow media-separating-member drive shaft which has one end fixed to the media-separating member and extends from the one end to outside the grinding chamber, wherein an internal space of the media-separating-member drive shaft serves as a material outlet.

As above, in the media mixing mill of the present invention, the agitating member is installed inside the grinding chamber and in adjacent relation to the inner wall of the grinding container (the following description will be made on an assumption that the agitating member is disposed in a lower region of the grinding chamber), so that the grinding media are moved upwardly from the lower region of the spherical-shaped grinding chamber where the agitating member is installed, and then, after being moved downwardly and separated by the media-separating member disposed adjacent to the central region, returned to the agitating member. Thus, a target material is pulverized or dispersed by a shearing force generated through contact with the grinding media moved by a relatively long distance with a relatively high degree of freedom while being mixed therewith. This makes it possible to achieve uniform dispersion so as to obtain a high-quality product.

Further, in the media mixing mill of the present invention, a centrifugal force is mostly converted into kinetic energy for the grinding media, so as to allow the grinding media to repeat a cycle of smoothly moving upwardly along a vicinity of the inner wall of the grinding container, and then moving downwardly from the central region to return to the grinding member. Thus, demixing of the grinding media is less likely to occur, and a dispersion or pulverization force is kept uniform. This also makes it possible to achieve uniform dispersion so as to obtain a high-quality product.

Furthermore, in the media mixing mill of the present invention, the grinding media have a relatively high degree of freedom, and energy is widely dispersed, so that the agitating member can be rotated at a high circumferential velocity without local heat generation. This makes it possible to achieve high-performance dispersion.

In view of the above functions, the media mixing mill of the present invention is suitably used for a material which would otherwise be likely to be changed in quality due to a strong dispersion force applied thereto.

DESCRIPTION OF THE PREFERRED EMBODIMENTS

With reference to the accompanying drawings, the present invention will now be described based on a media mixing mill according to one embodiment thereof. Although the following description will be made about a vertical-type mill, it is understood that the mill of the present invention may be a horizontal type.

Figure 1:
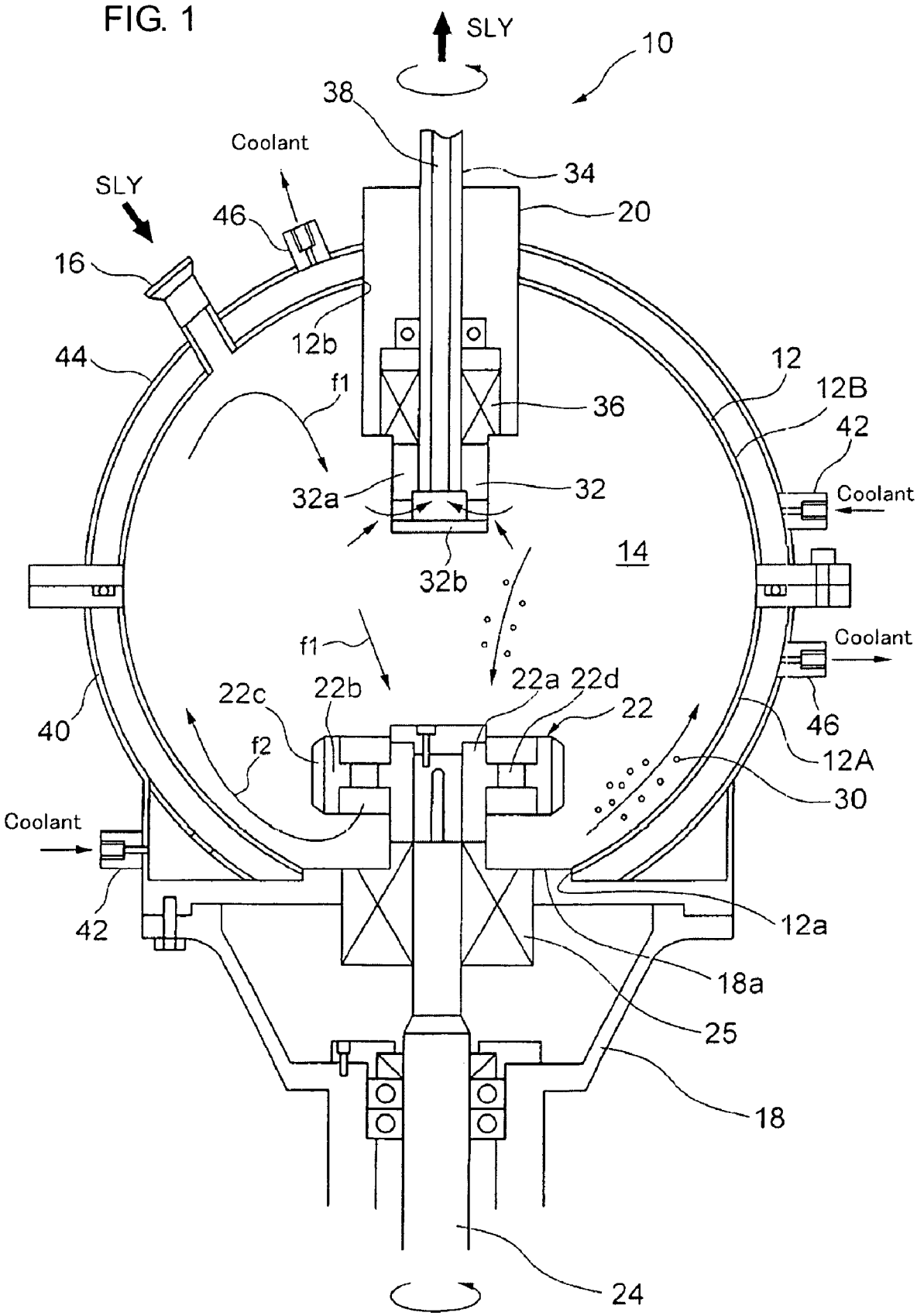
FIG. 1 is a sectional view showing a media mixing mill according to one embodiment of the present invention.

FIG. 1 shows a media mixing mill 10 according to one embodiment of the present invention. The media mixing mill 10 comprises a generally spherical-shaped grinding container 12. The grinding container 12 has a spherical-shaped grinding chamber 14 defined thereinside, and a material inlet 16 for introducing a target material being in a slurry form, into the grinding chamber 14. Although the grinding container 12 itself may be formed in any shape as long as the grinding chamber 14 has a spherical shape, it is preferable that the grinding container 12 has a spherical shape, as mentioned above. The grinding container 12 is formed with a cross-sectionally circular-shaped through-hole 12*a* in a middle position of a lower portion thereof (an after-mentioned jacket is also formed with a through-hole in the same manner), and a ring-shaped portion 18*a* protruding upwardly from a middle position of an upper portion of a frame 18 is fitted into the through-hole 12*a*. The grinding container 12 is further formed with a cross-sectionally circular-shaped through-hole 12*b* in a middle position of an upper portion thereof (the after-mentioned jacket is also formed with a through-hole in the same manner), and a cylindrical-shaped casing 20 is fitted into the through-hole 12*b*. The casing 20 is arranged to extend vertically in such a manner as to allow a lower end thereof to be located inside the grinding chamber 14.

An agitating member 22 is rotatably disposed in a middle position of a lower region of an internal space of the grinding chamber 14 of the grinding container 12. The agitating member 22 may have a conventional structure. For example, the agitating member 22 integrally includes a hub portion 22*a* disposed in a middle position thereof, an extension portion 22*b* extending radially outwardly from the hub portion 22*a* by a given distance, and a principal portion 22*c* formed in a gear teeth-like configuration and supported by an outer peripheral edge of the extension portion to serve as a main body of the agitating member 22. The extension portion 22*b* is formed with a plurality of through-holes 22*d* serving as a plurality of grinding media-circulating holes. A rotational drive shaft 24 serving as a grinding-member drive shaft is fixed to the hub portion 22*a*. The rotational drive shaft 24 is arranged to extend axially downwardly while penetrating through the frame 18. Although not illustrated, the rotational drive shaft 24 has a base end connected to a driving source via a conventional drive mechanism, so that it is rotationally driven in a direction indicated by the arrowed line in FIG. 1. Preferably, the rotational drive shaft 24 is arranged to allow a rotation axis thereof to pass through a center of the spherical-shaped grinding chamber 14. The rotational drive shaft 24 is provided with a shaft sealing device 25 (e.g., mechanical sealing device). As is commonly known in media mixing mills, bead-shaped grinding media 30 are contained in the grinding container 12 (in FIG. 1, the grinding media 30 are significantly enlargedly illustrated). Each of the grinding media 30 may have a diameter of 0.02 to 2 mm.

A centrifugal-type media-separating member 32 is rotatably disposed in an upper region adjacent to a central region of the internal space of the grinding chamber 14 of the grinding container 12 and in axially spaced-apart and opposed relation to the agitating member, to separate the grinding media 30 dispersed in the target material being in a slurry form, from the target material. Although it is preferable that the media-separating member 32 is a centrifugal impeller type, and arranged in concentric relation to the grinding member, respective axes thereof may be out of alignment. A hollow rotational drive shaft 34 is fixed to the media-separating member 32. The rotational drive shaft 34 is arranged to extend upwardly while penetrating through the casing 20. Although not illustrated, the rotational drive shaft 34 has a base end connected to a driving source via a conventional drive mechanism, so that it is rotationally driven in a direction indicated by the arrowed line in FIG. 1. The rotational drive shaft 34 is provided with a shaft sealing device 36 (e.g., mechanical sealing device). A hollow space of the rotational drive shaft 34 communicates with an internal space of the media-separating member 32 to form a material outlet 38.

Figure 2:
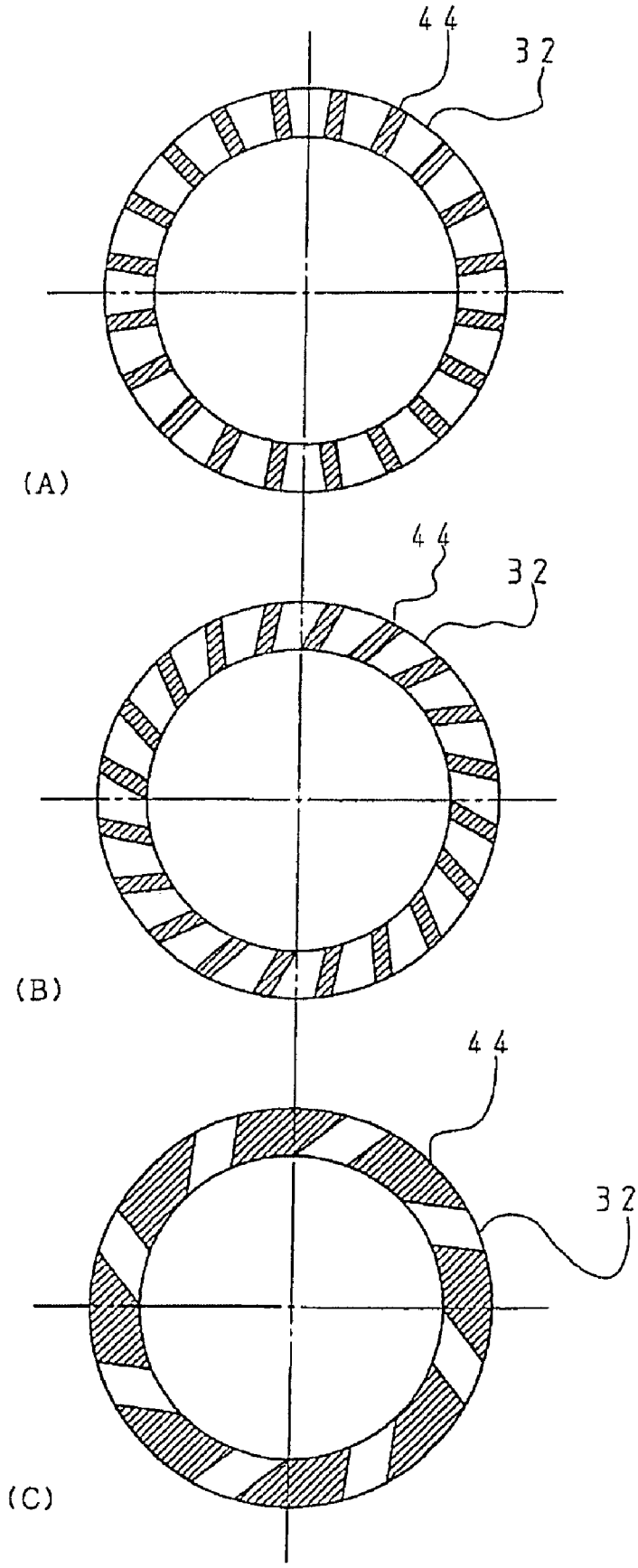
FIGS. 2(A), 2(B) and 2(C) are sectional views showing examples of a blade array of a media-separating member used in the media mixing mill illustrated in FIG. 1.

The media-separating member 32 has a plurality of blades 44 (see FIG. 2(A)) provided between a hub portion 32*a* and a closing plate 32*b* and arranged at even intervals in a circumferential direction thereof (arranged coaxially with the rotational drive shaft 34). The blades 44 may be arranged in a perfect radial pattern, as shown in FIG. 2(A), or may be arranged with a certain inclination, as shown in FIG. 2(B). Alternatively, as shown in FIG. 2(C), each of the blades 44 may be formed in a cross-sectionally rectangular shape having a width which gradually decreases in an inward direction of the media-separating member 32.

A jacket 40 is provided around an outer periphery of the grinding container 12 to allow a cooling medium or a heating medium (typically, a cooling medium, such as cooling water or coolant) to flow therethrough so as to adjust an internal temperature of the grinding chamber 14. The jacket 40 has a lower portion provided with a coolant inlet 42 for introducing coolant therethrough, and an upper portion provided with a coolant outlet 46 for discharging the coolant therefrom.

The grinding container 12 is adapted to be divided into two parts, along a plane which passes through the center of the grinding chamber 14 and orthogonally crosses through the rotation axis of the agitating member 22 (vertical axis). Thus, the grinding container 12 can be opened to facilitate a maintenance operation.

In the media mixing mill 10 according to this embodiment, the agitating member 22 is adapted to be driven at a rotational velocity ranging from 5 to 40 m/s, and the media-separating member 32 is adapted to be driven at a rotational velocity ranging from 10 to 20 m/s.

In an operation of the media mixing mill 10, the agitating member 22 is rotationally driven while introducing a target material in a slurry form containing particles to be pulverized, from the material inlet 16 into the grinding chamber 14. The slurry 9 introduced in the grinding chamber 14 is moved downwardly toward the agitating member 22 while riding on a rotating flow f1 (of the slurry and the grinding media 30) which is already formed inside the grinding chamber 14, and agitatingly mixed with the grinding media 30 by the agitating member 22. Then, the agitatingly-formed mixture of the slurry and the grinding media 30 is formed as a flow f2 moving upwardly along a vicinity of an inner wall of the grinding chamber 14. When the mixture reaches an upwardmost region, it is formed as the aforementioned flow f1. In a region adjacent to and slightly above the central region of the grinding chamber 14, a rotational movement is given to the mixture of the slurry and the grinding media 30 by the media-separating member 32. According to this rotational movement, the grinding media 30 having a relatively large mass are forcibly moved radially outwardly and separated from the slurry. In this process, a part of the pulverized particles having a relatively large particle size due to insufficient pulverization are moved radially outwardly together with the grinding medium. On the other hand, the slurry containing the remaining particles sufficiently pulverized and reduced in mass is introduced into the inner space of the media-separating member 32 and discharged to outside the media mixing mill 10 via the material outlet 38 inside the rotational drive shaft 34. In the above manner, in the flows f1, f2, the particles as a target material are adequately pulverized and dispersed through contact with the freely-moving grinding media, and therefore a high-quality product is obtained. Further, based on the above functions, the media mixing mill 10 according to this embodiment makes it possible to achieve pulverization providing a relatively narrow particle size distribution width.

In the media mixing mill 10 according to this embodiment, the agitating member 22 is sufficiently spaced apart from the media-separating member 32, and therefore an interference from the media-separating member 32 is extremely small.

What is claimed is:

1. A media mixing mill comprising: a vertical grinding container having a material inlet and a spherical-shaped grinding chamber; an agitating member rotatably installed in an inner bottom portion of the grinding chamber and in adjacent relation to an inner wall of the grinding container; grinding media contained in the grinding chamber; and a media centrifugal separator rotatably disposed in adjacent relation to a central region of the spherical-shaped grinding chamber and in opposed relation to the agitating member.

2. The media mixing mill as defined in claim 1 wherein the grinding container itself has a spherical shape.

3. The media mixing mill as defined in claim 1 wherein the agitating member is adapted to be rotatable about a rotation axis thereof passing through a center of the spherical-shaped grinding chamber.

4. The media mixing mill as defined in claim 3 wherein the grinding container is divided into two parts, along a plane which passes through the center of the grinding chamber and orthogonally crosses through the rotation axis of the agitating member.

5. The media mixing mill as defined in claim 1 which further comprises a jacket provided around an outer periphery of the grinding container to allow a cooling medium or a heating medium to flow therethrough so as to adjust an internal temperature of the grinding chamber.

6. The media mixing mill as defined in claim 1 wherein the agitating member is adapted to be driven at a rotational velocity ranging from 5 to 40 m/s.

7. The media mixing mill as defined in claim 1 which further comprises a hollow media separator drive shaft which has one end fixed to the media-separating member and extends from the one end to outside the grinding chamber, wherein an internal space of the media separator drive shaft serves as a material outlet.

* * * * *